US009249806B2

(12) United States Patent
Talaski

(10) Patent No.: US 9,249,806 B2
(45) Date of Patent: Feb. 2, 2016

(54) IMPELLER AND FLUID PUMP

(75) Inventor: Edward J. Talaski, Caro, MI (US)

(73) Assignee: TI Group Automotive Systems, L.L.C., Auburn Hills, MI (US)

( * ) Notice: Subject to any disclaimer, the term of this patent is extended or adjusted under 35 U.S.C. 154(b) by 807 days.

(21) Appl. No.: 13/360,206

(22) Filed: Jan. 27, 2012

(65) Prior Publication Data

US 2012/0201700 A1 Aug. 9, 2012

Related U.S. Application Data

(60) Provisional application No. 61/439,793, filed on Feb. 4, 2011, provisional application No. 61/446,331, filed on Feb. 24, 2011.

(51) Int. Cl.

| | |
|---|---|
| ***F04D 5/00*** | (2006.01) |
| ***F04D 29/18*** | (2006.01) |
| ***F04D 29/42*** | (2006.01) |

(52) U.S. Cl.

CPC ..... *F04D 29/188* (2013.01); *F04D 5/005* (2013.01); *F04D 5/007* (2013.01); *F04D 29/4273* (2013.01); *F04D 29/4293* (2013.01); *Y10T 29/49316* (2015.01)

(58) Field of Classification Search

CPC ..... F04D 5/005; F04D 5/007; F04D 29/188; F04D 29/4273; F04D 29/4293; F05B 2230/10–2230/104; F05D 2230/18

USPC ..... 415/55.1–55.7

See application file for complete search history.

(56) References Cited

U.S. PATENT DOCUMENTS

| | | | |
|---|---|---|---|
| 751,209 | A | 2/1904 | Schwarze |
| 777,360 | A | 12/1904 | Wyand |
| 945,742 | A | 1/1910 | Boeckel et al. |
| 1,340,091 | A | 5/1920 | Trane |
| 1,419,772 | A | 6/1922 | Sechrist |
| 1,655,749 | A | 1/1928 | Burks |
| 1,689,579 | A | 10/1928 | Burks |
| 1,871,209 | A | 8/1932 | Burks |
| 1,973,663 | A | 9/1934 | Shafer |
| 1,973,669 | A | 9/1934 | Spoor |
| 2,042,499 | A | 6/1936 | Brady |
| 2,045,851 | A | 6/1936 | Hamilton |
| 2,283,844 | A | 5/1942 | Brady, Jr. |
| 2,696,789 | A | 12/1954 | Fabig |
| 2,724,338 | A | 11/1955 | Roth |

(Continued)

FOREIGN PATENT DOCUMENTS

| | | |
|---|---|---|
| DE | 581808 | 8/1933 |
| DE | 729453 | 12/1942 |

(Continued)

OTHER PUBLICATIONS

EP 12153683.3 Search Report Dted Sep. 3, 2013.

(Continued)

*Primary Examiner* — Richard Edgar
*Assistant Examiner* — Brian O Peters
(74) *Attorney, Agent, or Firm* — Brinks Gilson & Lione

(57) ABSTRACT

A fluid pump may include an electric motor having an output shaft driven for rotation about an axis and a pump assembly coupled to the output shaft. The pump assembly has a first cap and a second cap with at least one pumping channel defined between the first and second caps, and an impeller between the first and second caps. The impeller is driven for rotation by the output shaft of the motor and includes a plurality of vanes in communication with the at least one pumping channel. Each vane has a root segment and a tip segment and a line from a base of the root segment to an outer edge of the tip segment trails a line extending from the axis of rotation to the base of the root segment by an angle of between 0° and 30° relative to the direction of rotation of the impeller.

29 Claims, 8 Drawing Sheets

(56) References Cited

U.S. PATENT DOCUMENTS 2,842,062 A 7/1958 Wright
2,936,714 A 5/1960 Balje
3,095,820 A 7/1963 Sanborn et al.
3,147,541 A 9/1964 Hathaway
3,150,222 A 9/1964 Blaustein et al.
3,259,072 A 7/1966 Carpenter
3,359,908 A 12/1967 Toma
3,392,675 A 7/1968 Taylor
3,418,991 A 12/1968 Shultz et al.
3,545,890 A 12/1970 Hubbard et al.
3,658,444 A 4/1972 Rhodes et al.
3,768,920 A 10/1973 Gerwin
3,782,851 A 1/1974 Hackbarth et al.
3,951,567 A 4/1976 Rohs
3,973,865 A 8/1976 Mugele
4,006,998 A 2/1977 Schonwald
4,141,674 A 2/1979 Schonwald
4,204,802 A 5/1980 Schonwald et al.
4,209,284 A 6/1980 Lochmann et al.
4,258,726 A 3/1981 Glaser et al.
4,306,833 A 12/1981 Sixsmith et al.
4,403,910 A 9/1983 Watanabe et al.
4,445,820 A * 5/1984 Hayashi et al. ..... 417/366
4,451,213 A 5/1984 Takei et al.
4,493,620 A 1/1985 Takei et al.
4,508,492 A 4/1985 Kusakawa et al.
4,538,968 A 9/1985 Kusakawa
4,556,363 A 12/1985 Watanabe et al.
4,591,311 A 5/1986 Matsuda et al.
4,678,395 A 7/1987 Schweinfurter
4,692,092 A 9/1987 Matsuda et al.
4,784,587 A 11/1988 Takei et al.
4,793,766 A 12/1988 Kumata
4,806,073 A 2/1989 Schonwald
4,822,258 A 4/1989 Matsuda et al.
4,834,612 A 5/1989 Lahn et al.
4,907,945 A 3/1990 Schoenwald
4,923,365 A 5/1990 Rollwage
4,938,659 A 7/1990 Bassler et al.
4,943,208 A 7/1990 Schoenwald
4,992,022 A 2/1991 Aust et al.
5,011,367 A 4/1991 Yoshida et al.
5,024,578 A 6/1991 Vansadia
5,080,554 A 1/1992 Kamimura
5,096,386 A 3/1992 Kassel
5,123,809 A 6/1992 Ito
5,141,396 A 8/1992 Schmidt et al.
5,160,249 A 11/1992 Iwai et al.
5,257,916 A 11/1993 Tuckey
5,265,997 A 11/1993 Tuckey
5,281,083 A 1/1994 Ito et al.
5,284,417 A 2/1994 Yu
5,299,908 A 4/1994 Robbie
5,310,308 A 5/1994 Yu et al.
5,328,325 A 7/1994 Strohl et al.
5,330,319 A 7/1994 Yu et al.
5,336,045 A 8/1994 Koyama et al.
5,372,475 A 12/1994 Kato et al.
5,375,971 A 12/1994 Yu
5,380,149 A 1/1995 Valsamidis
5,391,062 A 2/1995 Yoshioka
5,395,210 A 3/1995 Yamazaki et al.
5,401,147 A 3/1995 Yu
5,407,318 A 4/1995 Ito et al.
5,409,357 A 4/1995 Yu et al.
5,449,269 A 9/1995 Frank et al.
5,452,701 A 9/1995 Tuckey
5,468,119 A 11/1995 Huebel et al.
5,472,321 A 12/1995 Radermacher
5,487,639 A 1/1996 Asabuki et al.
5,513,950 A 5/1996 Yu
5,516,259 A 5/1996 Niederkofler et al.
5,516,263 A 5/1996 Nishida et al.
5,527,149 A 6/1996 Moss et al.
5,536,139 A 7/1996 Yamazaki et al.
5,549,446 A 8/1996 Gaston et al.
5,551,835 A 9/1996 Yu et al.
5,558,490 A 9/1996 Dobler et al.
5,580,213 A 12/1996 Woodward et al.
5,596,970 A 1/1997 Schoenberg et al.
5,601,398 A 2/1997 Treiber et al.
5,642,981 A 7/1997 Kato et al.
5,697,152 A 12/1997 Yamazaki et al.
5,702,229 A 12/1997 Moss et al.
5,709,531 A 1/1998 Nishida et al.
5,716,191 A 2/1998 Ito et al.
5,762,469 A 6/1998 Yu
5,785,490 A * 7/1998 Dobler et al. ..... 415/55.1
5,807,068 A 9/1998 Dobler et al.
5,921,746 A 7/1999 Yu et al.
5,960,775 A 10/1999 Tuckey
5,961,276 A 10/1999 Huebel et al.
5,975,843 A 11/1999 Ebihara
6,102,653 A 8/2000 Marx
6,113,363 A 9/2000 Talaski
6,116,851 A 9/2000 Oklejas, Jr.
6,132,185 A 10/2000 Wilhelm
6,135,730 A 10/2000 Yoshioka
6,152,687 A 11/2000 Wilhelm et al.
6,152,688 A 11/2000 Staab et al.
6,162,012 A 12/2000 Tuckey et al.
6,174,128 B1 1/2001 Yu
6,213,726 B1 4/2001 Tuckey
6,224,323 B1 5/2001 Murase et al.
6,231,300 B1 5/2001 Wilhelm et al.
6,231,318 B1 5/2001 Cotton et al.
6,280,157 B1 8/2001 Cooper
6,283,704 B1 9/2001 Yoshioka
6,302,639 B1 10/2001 Endler et al.
6,309,173 B1 10/2001 Marx
6,322,319 B1 11/2001 Yoshioka
6,402,460 B1 6/2002 Fischer et al.
6,422,808 B1 7/2002 Moss et al.
6,425,734 B2 7/2002 Marx
6,435,810 B1 8/2002 Fischer et al.
6,439,833 B1 8/2002 Pickelman et al.
6,443,691 B1 9/2002 Nather
6,443,693 B1 9/2002 Eck
6,447,242 B1 9/2002 Wilhelm
6,454,520 B1 9/2002 Pickelman et al.
6,454,521 B1 9/2002 Anderson et al.
6,454,522 B2 9/2002 Sakamoto et al.
6,464,450 B1 10/2002 Fischer
6,468,027 B2 10/2002 Narisako et al.
6,471,466 B2 10/2002 Marx et al.
6,481,958 B1 11/2002 Wilhelm et al.
6,497,552 B2 12/2002 Kobayashi et al.
6,499,941 B1 12/2002 Fischer
6,503,049 B2 1/2003 Marx et al.
6,511,283 B1 1/2003 Yoshioka
6,517,310 B2 2/2003 Marx et al.
6,527,505 B2 3/2003 Yu et al.
6,527,506 B2 3/2003 Pickelman et al.
6,533,538 B2 3/2003 Aslam et al.
6,540,474 B2 4/2003 Marx et al.
6,547,515 B2 4/2003 Ross
6,561,765 B2 5/2003 Yu et al.
6,604,905 B1 8/2003 Yu et al.
6,623,237 B2 9/2003 Harris et al.
6,638,009 B2 10/2003 Honma
6,641,361 B2 11/2003 Yu
6,655,909 B2 12/2003 Yu et al.
6,659,713 B1 12/2003 Fujii et al.
6,669,437 B2 12/2003 Yu et al.
6,675,777 B2 1/2004 Gaston et al.
6,675,778 B1 1/2004 Kemper et al.
6,688,844 B2 2/2004 Yu
6,702,546 B2 3/2004 Takagi et al.
6,715,471 B2 4/2004 Hiraiwa et al.
6,715,986 B2 4/2004 Takei
6,729,841 B2 5/2004 Kusagaya et al.
6,733,230 B2 5/2004 Miura et al.
6,733,249 B2 5/2004 Maier et al.
6,739,844 B1 5/2004 Yu et al.

(56) References Cited

U.S. PATENT DOCUMENTS

| | | | |
|---|---|---|---|
| 6,758,656 | B2 | 7/2004 | Maier et al. |
| 6,767,179 | B2 | 7/2004 | Kusagaya et al. |
| 6,767,180 | B2 | 7/2004 | Kobayashi et al. |
| 6,767,181 | B2 | 7/2004 | Yu et al. |
| 6,824,361 | B2 | 11/2004 | Yu et al. |
| 6,832,901 | B2 | 12/2004 | Kuehn et al. |
| 6,837,675 | B2 | 1/2005 | Usui et al. |
| 6,846,155 | B2 | 1/2005 | Takami et al. |
| 6,851,922 | B2 | 2/2005 | Kuehn et al. |
| 6,890,144 | B2 | 5/2005 | Yu et al. |
| 6,905,310 | B2 | 6/2005 | Kawamoto et al. |
| 6,932,562 | B2 | 8/2005 | Ross |
| 6,942,447 | B2 | 9/2005 | Ikeya |
| 6,974,302 | B2 | 12/2005 | Motojima et al. |
| 6,984,099 | B2 | 1/2006 | Yu et al. |
| 7,008,174 | B2 | 3/2006 | Yu et al. |
| 7,014,432 | B2 | 3/2006 | Iwanari |
| 7,037,066 | B2 | 5/2006 | Moss |
| 7,048,494 | B2 | 5/2006 | Iijima et al. |
| 7,118,345 | B2 | 10/2006 | Wu et al. |
| 7,121,786 | B2 | 10/2006 | Yonehara |
| 7,125,218 | B2 | 10/2006 | Koyama et al. |
| 7,156,610 | B2 | 1/2007 | Jang et al. |
| 7,160,079 | B2 | 1/2007 | Iijima et al. |
| 7,165,932 | B2 | 1/2007 | Yu et al. |
| 7,217,083 | B2 | 5/2007 | Yasuda et al. |
| 7,217,084 | B2 | 5/2007 | Yu et al. |
| 7,217,085 | B2 | 5/2007 | Inuzuka |
| 7,244,094 | B2 | 7/2007 | Miura et al. |
| 7,264,440 | B2 | 9/2007 | Ikeya |
| 7,267,524 | B2 | 9/2007 | Yu |
| RE39,891 | E | 10/2007 | Pickelman et al. |
| 7,284,950 | B2 | 10/2007 | Narisako et al. |
| 7,416,381 | B2 | 8/2008 | Baek et al. |
| 7,442,015 | B2 | 10/2008 | Oi et al. |
| 7,455,496 | B2 | 11/2008 | Motojima et al. |
| 7,500,820 | B2 | 3/2009 | Inuzuka et al. |
| 7,507,065 | B2 | 3/2009 | Ando et al. |
| 7,559,305 | B1 | 7/2009 | Scott |
| 7,559,315 | B1 | 7/2009 | Yu et al. |
| 7,585,147 | B2 | 9/2009 | Yonehara |
| 7,597,543 | B2 | 10/2009 | Narisako et al. |
| 7,632,060 | B2 | 12/2009 | Yu |
| 7,658,180 | B2 | 2/2010 | Gei.beta.el |
| 7,708,533 | B2 | 5/2010 | Deichmann et al. |
| 7,722,311 | B2 | 5/2010 | Peterson et al. |
| 7,748,949 | B2 | 7/2010 | Wattai et al. |
| 7,766,604 | B2 | 8/2010 | Honda et al. |
| 2001/0036400 | A1 | 11/2001 | Kobayashi et al. |
| 2001/0041132 | A1 | 11/2001 | Marx et al. |
| 2002/0021961 | A1 | 2/2002 | Pickelman et al. |
| 2002/0071758 | A1 | 6/2002 | Aslam et al. |
| 2002/0141860 | A1 | 10/2002 | Kusagaya et al. |
| 2002/0168261 | A1 | 11/2002 | Honma |
| 2003/0086783 | A1 | 5/2003 | Kobayashi |
| 2003/0118437 | A1 | 6/2003 | Takami et al. |
| 2003/0118438 | A1 | 6/2003 | Usui et al. |
| 2003/0118439 | A1 | 6/2003 | Usui et al. |
| 2004/0013513 | A1 | 1/2004 | Jeswani et al. |
| 2004/0136823 | A1 | 7/2004 | Baek et al. |
| 2004/0228721 | A1 | 11/2004 | Takagi et al. |
| 2004/0258545 | A1 | 12/2004 | Yu |
| 2007/0041825 | A1 | 2/2007 | Hayakawa |
| 2007/0077138 | A1 | 4/2007 | Tsuzuki et al. |
| 2007/0183886 | A1 | 8/2007 | Koyama et al. |
| 2007/0231120 | A1 | 10/2007 | Narisako et al. |
| 2007/0234117 | A1 | 10/2007 | Elliott et al. |
| 2007/0264117 | A1 | 11/2007 | Yoshida et al. |
| 2007/0274846 | A1 | 11/2007 | Deubner et al. |
| 2008/0031733 | A1* | 2/2008 | Homma ..... 415/208.1 |
| 2008/0056884 | A1 | 3/2008 | Ikeya et al. |
| 2008/0085181 | A1 | 4/2008 | Hanai |
| 2008/0089776 | A1 | 4/2008 | Hazama et al. |
| 2008/0138189 | A1 | 6/2008 | Hazama et al. |
| 2008/0193297 | A1 | 8/2008 | Yildirim et al. |
| 2008/0253878 | A1 | 10/2008 | Ikeya et al. |
| 2009/0060709 | A1 | 3/2009 | Tomomatsu et al. |
| 2009/0074559 | A1 | 3/2009 | Inuzuka |
| 2009/0304527 | A1 | 12/2009 | Wattai et al. |
| 2010/0021282 | A1 | 1/2010 | Geissel |
| 2010/0054949 | A1 | 3/2010 | Jang et al. |

FOREIGN PATENT DOCUMENTS

| | | |
|---|---|---|
| DE | 1005374 | 3/1957 |
| DE | 1224149 | 9/1966 |
| DE | 1528823 | 10/1969 |
| DE | 1921945 | 1/1970 |
| DE | 2112980 | 9/1972 |
| DE | 2112762 | 10/1972 |
| DE | 3108214 | 9/1982 |
| DE | 8703840 | 7/1988 |
| DE | 8808920 | 9/1988 |
| DE | 3823514 | 1/1990 |
| DE | 8908579 | 11/1990 |
| DE | 325396 | 2/1991 |
| DE | 4127768 | 2/1993 |
| DE | 9218095 | 9/1993 |
| DE | 4315448 | 12/1993 |
| DE | 9314384 | 2/1995 |
| DE | 4340011 | 6/1995 |
| DE | 4341563 | 6/1995 |
| DE | 19518101 | 12/1995 |
| DE | 19504079 | 8/1996 |
| DE | 19744237 | 4/1998 |
| DE | 19822629 | 11/1999 |
| EP | 70529 | 1/1983 |
| EP | 97924 | 1/1984 |
| EP | 118027 | 9/1984 |
| EP | 601530 | 6/1994 |
| EP | 735271 | 10/1996 |
| EP | 745469 | 12/1996 |
| EP | 894198 | 3/1999 |
| EP | 1739310 | 1/2007 |
| FR | 736827 | 11/1932 |
| FR | 2712935 | 6/1995 |
| FR | 2786191 | 3/1999 |
| FR | 2786192 | 3/1999 |
| FR | 2786193 | 3/1999 |
| GB | 318026 | 8/1929 |
| GB | 1085418 | 10/1967 |
| GB | 2036178 | 6/1980 |
| GB | 2073819 | 10/1981 |
| GB | 2253010 | 8/1992 |
| GB | 2289918 | 12/1995 |
| GB | 2292190 | 2/1996 |
| JP | S5710794 | 1/1982 |
| JP | S5781191 | 5/1982 |
| JP | S5799298 | 6/1982 |
| JP | H0381596 | 8/1991 |
| JP | H06159282 | 6/1994 |
| JP | H06272685 | 9/1994 |
| JP | H06288379 | 10/1994 |
| JP | H06299983 | 10/1994 |
| JP | H0754726 | 2/1995 |
| JP | H07189973 | 7/1995 |
| JP | H0979169 | 3/1997 |
| JP | H09126179 | 5/1997 |
| JP | H09144682 | 6/1997 |
| JP | H10213089 | 8/1998 |
| JP | 2002266784 | 9/2002 |
| JP | 2002266785 | 9/2002 |
| JP | 2002327694 | 11/2002 |
| JP | 2005120834 | 5/2005 |
| JP | 2007132196 | 5/2007 |

OTHER PUBLICATIONS

EP Partial Search Report, Apr. 2, 2013, 5 pages.

* cited by examiner

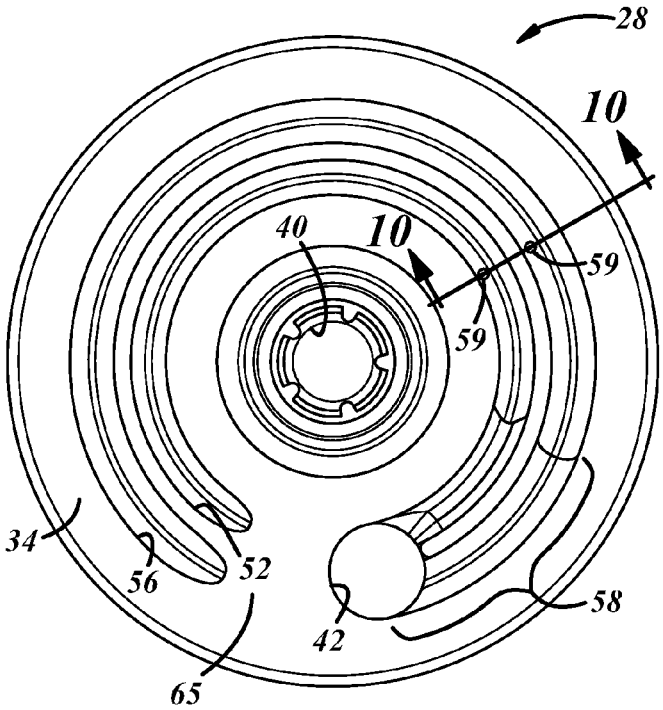
FIG. 7
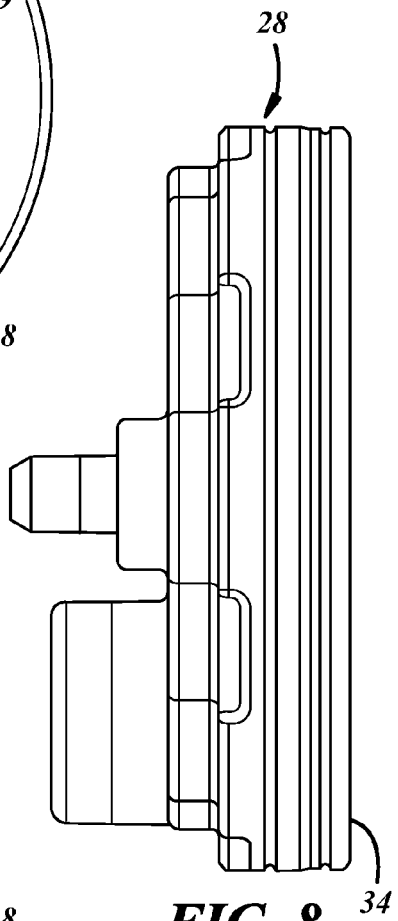
FIG. 8
FIG. 9
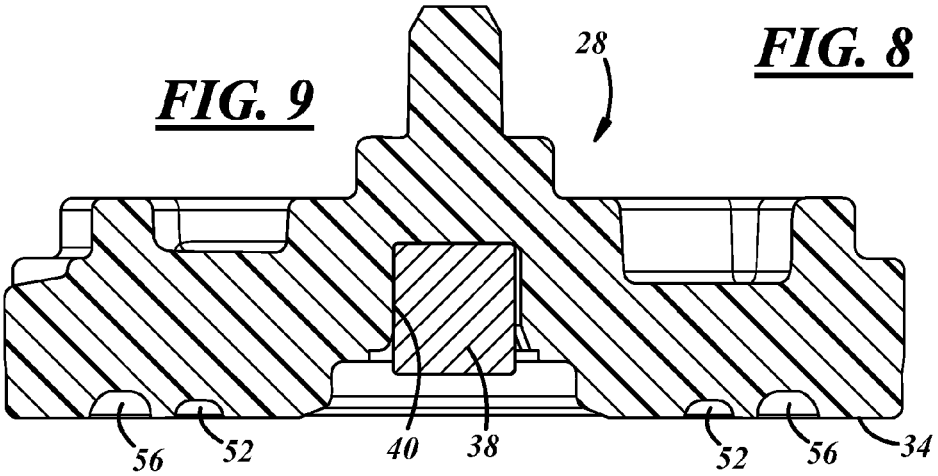

IMPELLER AND FLUID PUMP

REFERENCE TO COPENDING APPLICATIONS

This application claims the benefit of U.S. Provisional Patent Application Ser. Nos. 61/439,793 filed Feb. 4, 2011 and 61/446,331 filed Feb. 24, 2011, which are incorporated herein by reference in their entirety.

TECHNICAL FIELD

The present disclosure relates generally to fuel pumps and more particularly to a turbine type fuel pump.

BACKGROUND

Electric motor driven pumps may be used to pump various liquids. In some applications, like in automotive vehicles, electric motor driven pumps are used to pump fuel from a fuel tank to a combustion engine. In applications like this, turbine type fuel pumps having an impeller with a plurality of vanes may be used.

SUMMARY

A fluid pump may include an electric motor having an output shaft driven for rotation about an axis and a pump assembly coupled to the output shaft of the motor. The pump assembly has a first cap and a second cap with at least one pumping channel defined between the first cap and the second cap, and an impeller received between the first cap and the second cap. The impeller is driven for rotation by the output shaft of the motor and includes a plurality of vanes in communication with the at least one pumping channel. Each vane has a root segment and a tip segment and a line from a base of the root segment to an outer edge of the tip segment trails a line extending from the axis of rotation to the base of the root segment by an angle of between 0° and 30° relative to the direction of rotation of the impeller.

An impeller for a fluid pump includes a hub having an opening adapted to receive a shaft that drives the impeller for rotation, a mid-hoop spaced radially from the hub and an outer hoop spaced radially from the mid-hoop, and inner and outer arrays of vanes. The inner array of vanes is located radially outwardly of the hub and inwardly of the mid-hoop. The outer array of vanes is located radially outwardly of the mid-hoop. Each vane in the inner array and the outer array has a leading face and a trailing face spaced circumferentially behind the leading face relative to the intended direction of rotation of the impeller. Each vane has a root segment and a tip segment extending generally radially outwardly from the root segment, and each vane is oriented so that a line from a base of the root segment to an outer edge of the tip segment trails a line extending from the axis of rotation to the base of the root segment by an angle of between 0° and 30°, relative to the direction of rotation of the impeller.

A method of making an impeller includes forming an impeller having a plurality of vanes and adapted to be rotated about an axis, forming a body that defines a radially outer sidewall of an impeller cavity in which the impeller rotates, and machining an axial face of the impeller and the body while the impeller is disposed radially inwardly of the sidewall to provide a similar axial thickness of both the sidewall and impeller.

BRIEF DESCRIPTION OF THE DRAWINGS

The following detailed description of exemplary embodiments and best mode will be set forth with reference to the accompanying drawings, in which:

FIG. 7 is a top view of the lower cap showing an upper surface of the lower cap;

FIG. 8 is a side view of the lower cap;

FIG. 9 is a sectional view of the lower cap;

DETAILED DESCRIPTION OF PRESENTLY PREFERRED EMBODIMENTS

Figure 1:
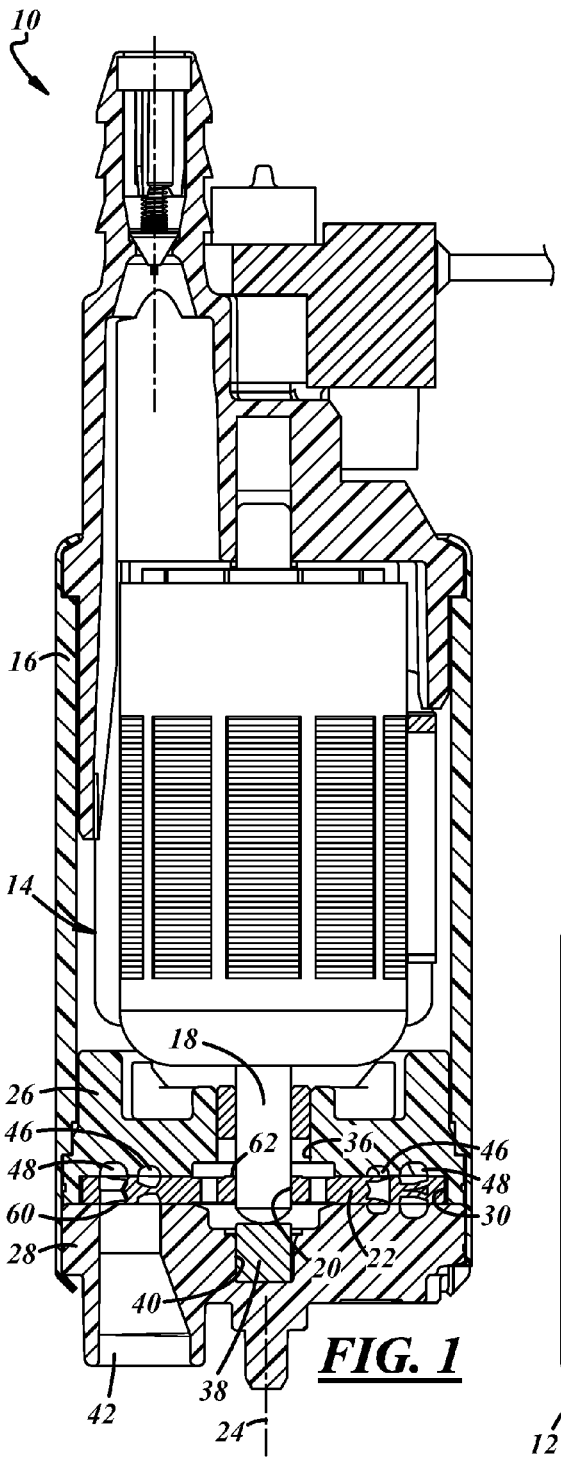
FIG. 1 is a sectional view of an exemplary fluid pump showing portions of an electric motor and pumping assembly of the fluid pump.
Figure 5:
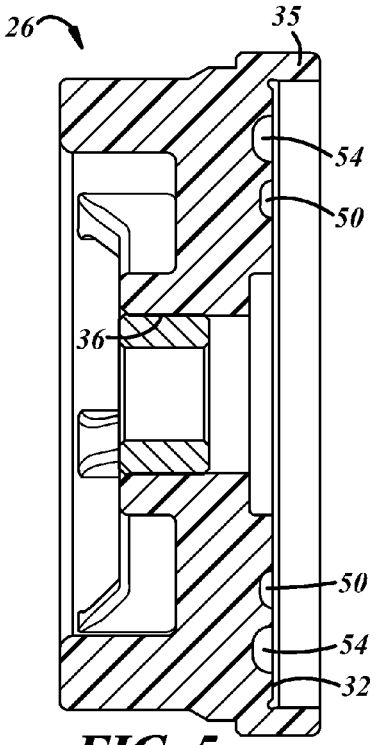
FIG. 5 is a sectional view of the upper cap.

Referring in more detail to the drawings, FIG. 1 illustrates a liquid pump 10 that has a turbine type or impeller pump assembly 12 that may be driven for rotation by an electric motor 14. The pump 10 can used to pump any suitable liquid including, and for purposes of the rest of this description, automotive fuels. In this example, the pump 10 may be utilized in an automotive fuel system to supply fuel under pressure to the vehicle's engine. The fuel may be of any suitable type, and the pump 10 may be adapted for use in a so-called "flex fuel vehicle" that may use standard gasoline as well as alternative fuels like ethanol based E85 fuel.

The motor 14 and associated components may be of conventional construction and may be enclosed, at least in part, by an outer housing or sleeve 16. The pump assembly 12 may also be enclosed, at least in part, by the sleeve 16 with an output shaft 18 of the motor 14 received within a central opening 20 of an impeller 22 to rotatably drive the impeller 22 about an axis 24 of rotation.

Figure 2:
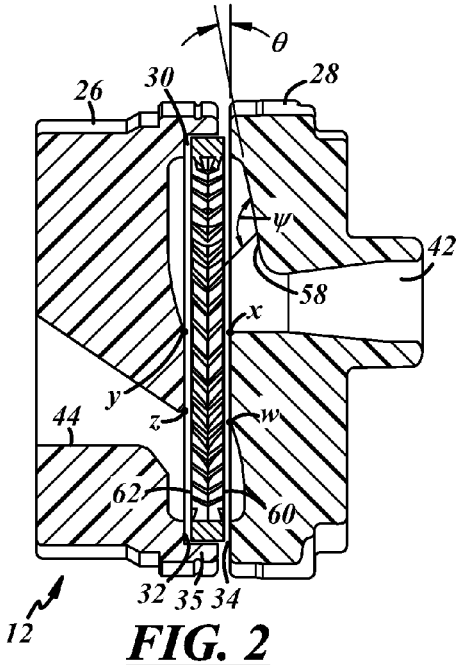
FIG. 2 is a sectional view of a pumping assembly of the fluid pump showing upper and lower caps and an impeller.
Figure 3:
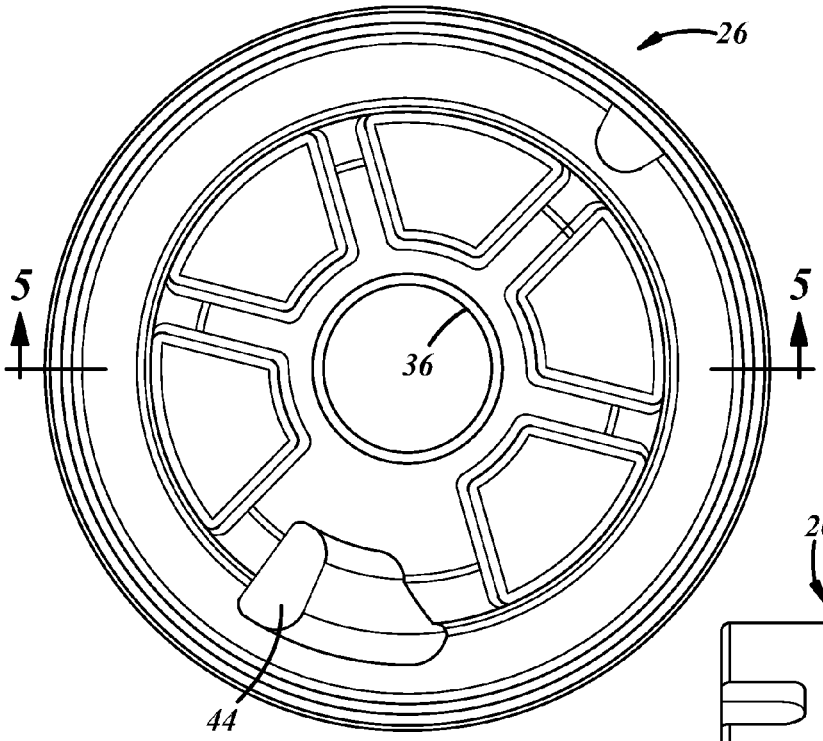
FIG. 3 is a top view of the upper cap.
Figure 4:
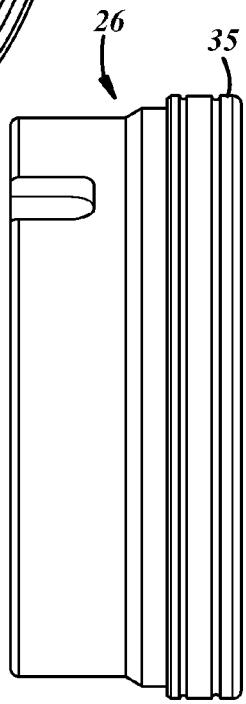
FIG. 4 is a side view of the upper cap.
Figure 6:
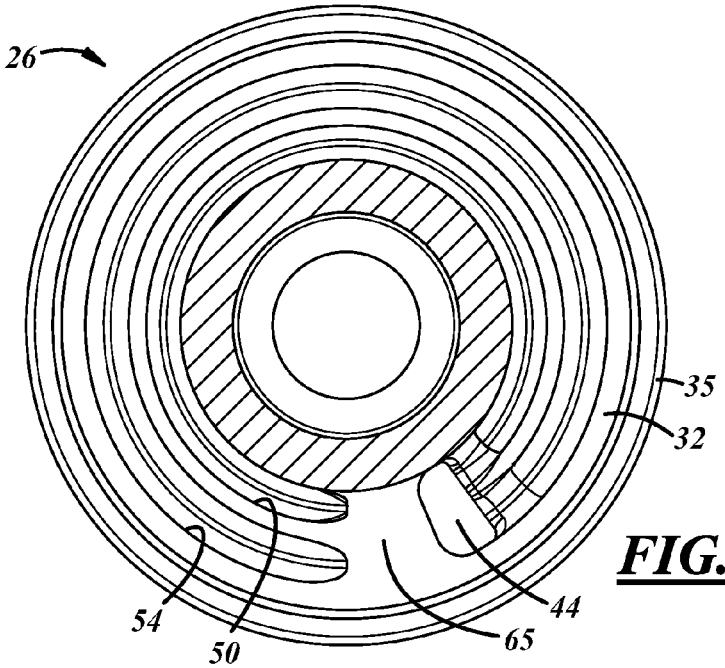
FIG. 6 is a bottom view of the upper cap showing a lower surface of the upper cap.

As shown in FIGS. 1 and 2, the pump assembly 12 may include a first or lower cap 28 and a second or upper cap 26 held together and generally encircled by the sleeve 16. An impeller cavity 30 in which the impeller 22 is received, may be defined between a lower surface 32 of an upper cap 26 and an upper surface 34 of a lower cap 28. The lower surface 32 and upper surface 34 may be generally flat or planar, and may extend perpendicularly to the axis 24 of rotation. The motor output shaft 18 may extend through a central passage 36 in the upper cap 26, be coupled to and project through the opening 20 in the impeller 22 with an end of the shaft 18 supported by a bearing 38 located in a blind bore 40 in the lower cap 28.

One or more fuel pumping channels 46, 48 (FIG. 1) are defined within the impeller cavity 30. The pumping channels 46, 48 may be defined by and between the impeller 22 and the upper and lower caps 26, 28. The pumping channels 46, 48 may communicate with and extend between an inlet passage 42 and an outlet passage 44, so that fuel enters the pumping channels 46, 48 from the inlet passage 42 and fuel is discharged from the pumping channels 46, 48 through the outlet passage 44. In the implementation shown, two pumping channels are provided, with an inner pumping channel 46 disposed radially inwardly or an outer pumping channel 48. The lower cap 28 (FIGS. 1, 2, 7-9) may define all or part of the inlet passage 42 through which fuel flows from a fluid reservoir or fuel tank (not shown) into the pumping channels 46, 48. The upper cap 26 (FIGS. 1-6) may define all or part of an outlet passage 44 through which pressurized fuel is discharged from the pumping channels 46, 48.

Figure 10:
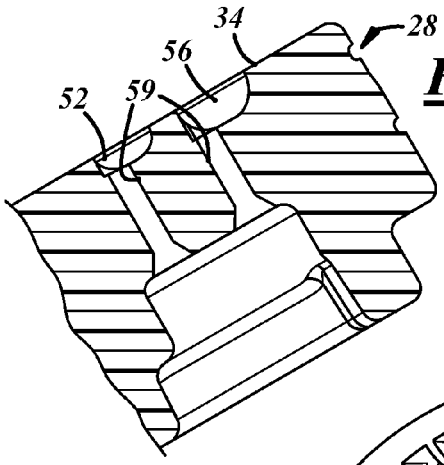
FIG. 10 is a fragmentary sectional view of a portion of the lower cap showing vent passages formed therein.
Figure 11:
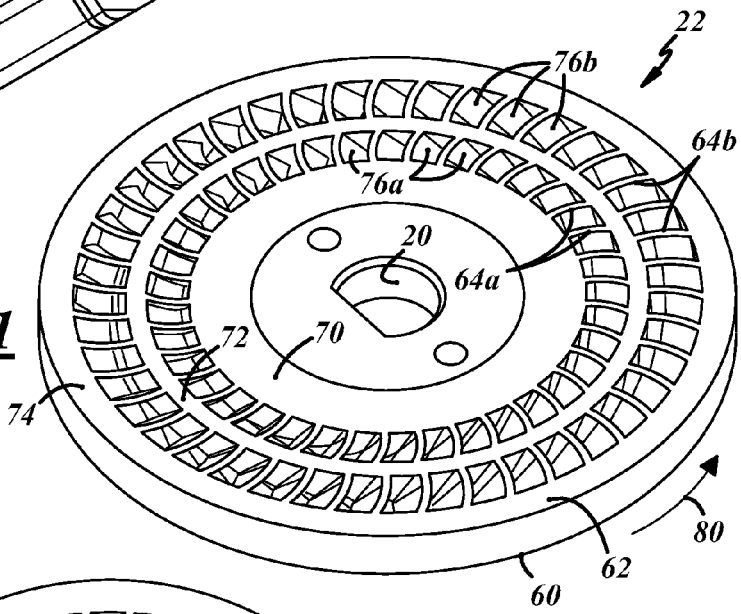
FIG. 11 is a perspective view of the impeller.
Figure 12:
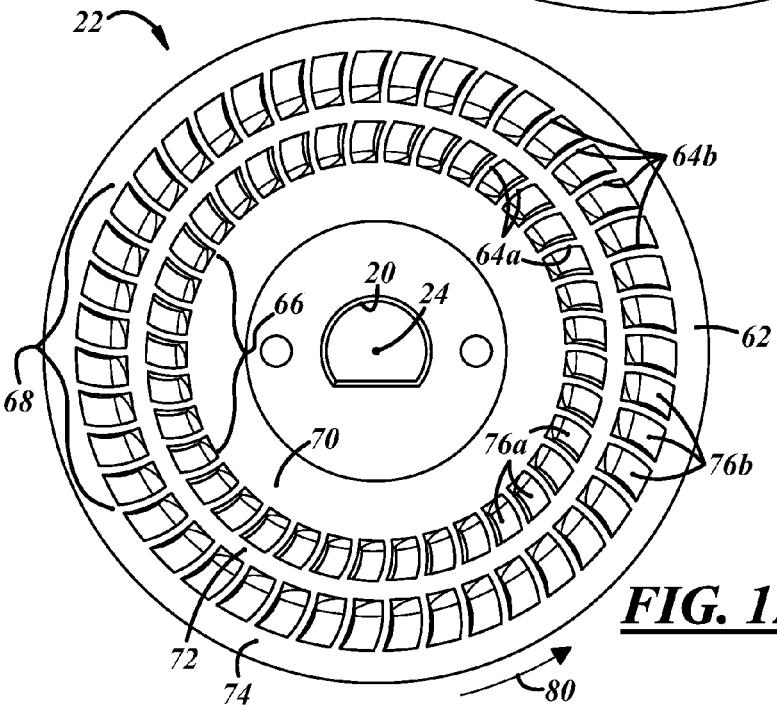
FIG. 12 is a top view of the impeller.
Figure 13:
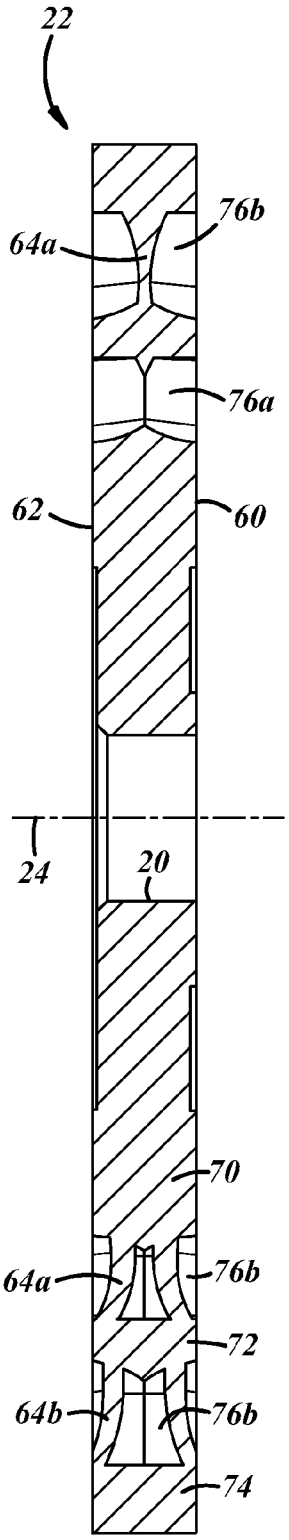
FIG. 13 is a sectional view of the impeller taken along line 13-13 in FIG. 12.

The inner pumping channel 46 may be defined in part by opposed grooves, with one groove 50 (FIGS. 5 and 6) formed in the lower surface 32 of the upper cap 26 and the other groove 52 (FIGS. 7 and 9) formed in the upper surface 34 of the lower cap 28. The outer pumping channel 48 may also be defined in part by opposed grooves, with one groove 54 (FIGS. 5 and 6) formed in the lower surface 32 of the upper cap 26 and the other groove 56 (FIGS. 7 and 9) formed in an upper surface 34 of the lower cap 28. The grooves 50-56 may all be symmetrically shaped and sized, or, they could be non-symmetrically shaped and/or sized. For example, the grooves 50, 52 defining part of the inner pumping channel 46 could be generally the same in the upper and lower caps 26, 28, but different from the grooves 54, 56 defining part of the outer pumping channel 46. As shown in FIG. 10, vent paths 59 may be provided for one or both pumping channels 46, 48 to permit vapor to escape or be expelled from the channels.

As shown in FIGS. 2 and 7, the inlet passage 42 may lead to an entrance portion 58 of the pumping channels 46, 48, with the entrance portion of outer pumping channel 48 shown. In the entrance portion 58, the depth of the pumping channel 48 may change from a greater depth adjacent to the inlet passage 42 to a lesser depth downstream thereof. The reduction in flow area downstream of the inlet passage 42 facilitates increasing the pressure and velocity of the fuel as it flows through this region of the pump assembly 12. In at least some implementations, the entrance portion may be disposed at an angle θ (FIG. 2) of between about 0° and 30°. In one presently preferred application, angle θ is between about 13° and 14°.

The outer pumping channel 48, as shown in FIGS. 5, 6, 7 and 9, may have a cross-sectional area that is larger than that of the inner pumping channel 46. The inner pumping channel 46 may operate at a lower tangential velocity and a higher pressure coefficient than the outer pumping channel 48 (due to the smaller radius and the shorter circumferential length of the inner pumping channel). In order to reduce leakage and/or backflow in the inner channel 46, as well as to maximize output flow, a smaller cross-sectional area may be used for the inner pumping channel 46 compared to the outer pumping channel 48.

The pumping channels 46, 48 may extend circumferentially or for an angular extent of less than 360°, and in certain applications, about 300-350° about the axis of rotation. This provides a circumferential portion of the upper and lower caps 26, 28 without any grooves, and where there is limited axial clearance between the upper surface 34 of the lower cap 28 and the impeller lower face 60, and the lower surface 32 of the upper cap 26 and upper face 62 of the impeller 22. This circumferential portion without grooves may be called a stripper portion or partition 65 and is intended to isolate the lower pressure inlet end of the pumping channels 46, 48 from the higher pressure outlet end of the pumping channels. Additionally, there may be generally no, or only a limited amount, of cross fluid communication between the inner and outer pumping channels 46, 48. Limited cross fluid communication between the pumping channels 46, 48 may be desirable to provide a lubricant or a fluid bearing between the rotating impeller 22 and the stationary caps 26, 28.

As shown in FIG. 2, in at least one implementation, a radially inward upstream edge of the inlet 42 at the face 34 of the lower body 28 (shown at point X) may be radially aligned with a radially inward upstream edge of the inlet at the face 32 of the upper body 26 (shown at point Y). That is, a line connecting point X and point Y may be parallel to the axis of rotation. Further, the radially inward downstream edge of the outlet 44 at the face 34 of the lower body 28 (shown at point W) may be circumferentially offset from the radially inward downstream edge of the outlet 44 at the face 32 of the upper body 26 (shown at point Z) by an angle A1 between about 0° and 20°, with a presently preferred offset in one application being about 4°. Further, points X and Y may be circumferentially offset from point Z by an angle A2 of about 10° to 25°, with a presently preferred offset in one application being about 23°. These angles may be measured between lines that are parallel to the axis of rotation and extend through the noted points.

The pumping channels 46, 48 may also be defined in part by the impeller 22. As shown in FIGS. 1 and 11-16, impeller 22 may be a generally disc-shaped component having a generally planar upper face 62 received adjacent to the lower surface 32 of the upper cap 26, and a generally planar lower face 60 received adjacent to the upper surface 34 of the lower cap 28. The impeller 22 may include a plurality of vanes 64*a,b* each radially spaced from the axis of rotation 24 and aligned within a pumping channel 46 or 48. In the implementation shown, where inner and outer pumping channels are provided, the impeller includes an inner array 66 of vanes 64*a* that are rotated through the inner pumping channel 46 and an outer array 68 of vanes 64*b* that are rotated through the outer pumping channel 48.

A circular hub 70 of the impeller 22 may be provided radially inwardly of the inner array 66 of vanes and a key hole or non-circular hole 20 may be provided to receive the motor output shaft 18 such that the shaft and impeller co-rotate about axis 24. A mid-hoop 72 may be defined radially between the inner and outer vane arrays 66, 68, and an outer hoop 74 may be provided or formed radially outward of the outer vane array 68. To prevent or minimize fuel flow between the inner and outer pumping channels 46, 48 and to prevent or reduce fuel leakage in general, the upper face 62 and lower face 60 of the impeller 22 may be arranged in close proximity to, and perhaps in a fluid sealing relationship with, the lower surface 32 of the upper cap 26 and the upper surface 34 of the lower cap 28, respectively. Vane pockets 76*a,b* may be formed between each pair of adjacent vanes 64*a,b* on the impeller 22, and between the mid-hoop 72 and outer hoop 74. In the example shown in the drawings, the vane pockets 76*a,b* of both the inner and outer vane arrays 66, 68 are open on both their upper and lower axial faces, such that the vane pockets 76*a,b* are in fluid communication with the upper and lower grooves 50-56. Inner and outer vane arrays 66, 68 respectively propel the fuel through circumferentially extending inner and outer pumping channels 46, 48 as the impeller 22 is driven for rotation.

With reference now to FIGS. 11-16, the inner vane array 66 includes numerous vanes 64*a* that each project generally radially outwardly from the inner hub 70 to the mid-hoop 72. The outer vane array 68 includes numerous vanes 64*b* that each project generally radially outwardly from the mid-hoop 72 to the outer hoop 74. Thus, the mid-hoop 72 separates the inner vane array 66 from the outer vane array 68. The vanes 64*a,b* of both the inner and outer vane arrays 66, 68 and the mid-hoop 72 and outer hoop 74 may extend axially the same distance, generally denoted by dimension "a" on FIGS. 14 and 15. Each vane 64*a,b* may have a desired circumferential thickness denoted by dimension "b" on FIGS. 14 and 15. The shape, orientation and spacing between the vanes 64*a* of the inner vane array 66 may be different than for the vanes 64*b* of the outer vane array 68, or the arrangement of the vanes 64*a*, 64*b* in both vane arrays may be the same. In the example shown in the drawings, the shape and orientation of the vanes 64*a,b* is the same in the inner and outer vane arrays 66, 68, although the inner array 66 is smaller radially and circumferentially than the outer array 68 and preferably has fewer vanes than the outer array.

Figure 14:
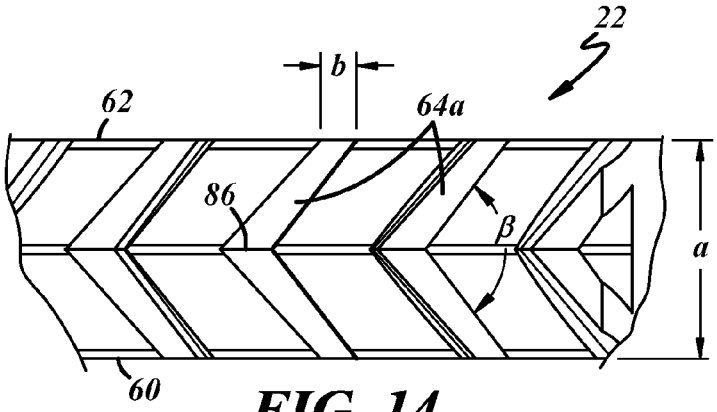
FIG. 14 is an enlarged, fragmentary sectional view taken along line 14-14 in FIG. 12.
Figure 15:
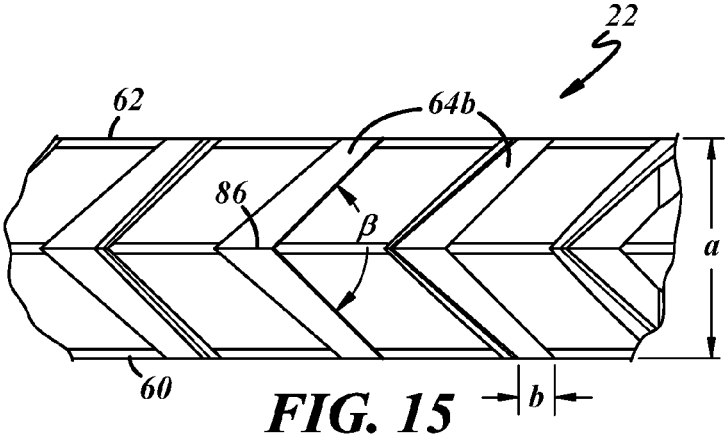
FIG. 15 is an enlarged, fragmentary sectional view taken along line 15-15 in FIG. 12.
Figure 16:
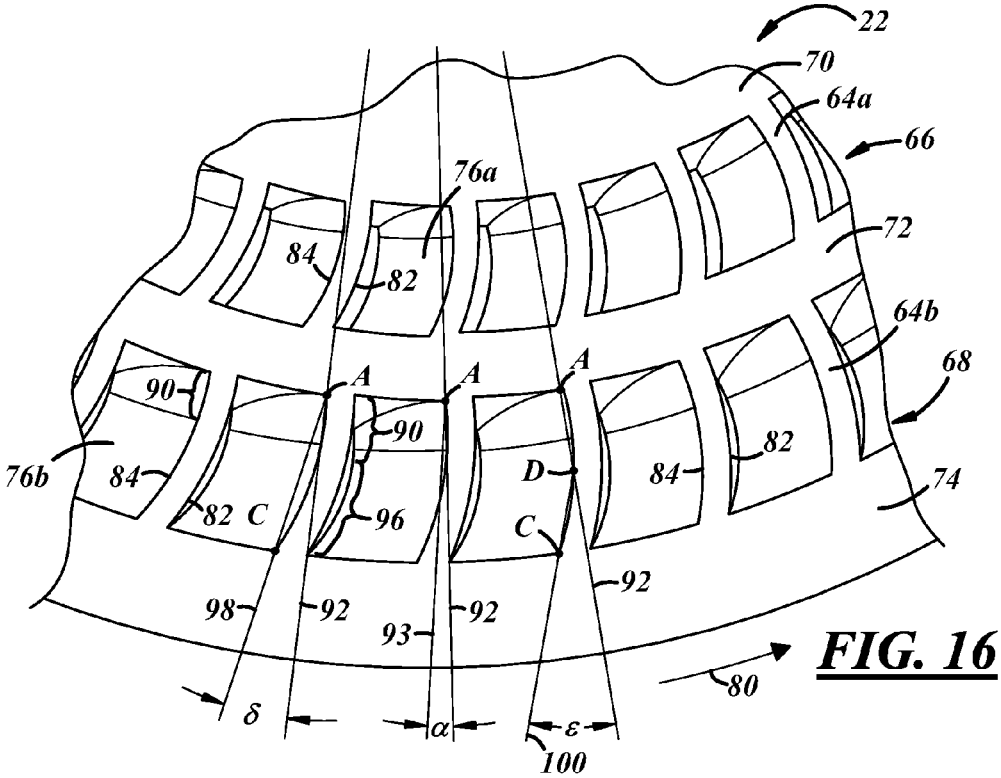
FIG. 16 is an enlarged, fragmentary view of a portion of the impeller.

Turning now to FIG. 16, there is shown an enlarged view of part of the inner and outer vane arrays 66, 68. The following description is directed primarily to the outer vane array 68 but applies also to the inner vane array 66, unless otherwise stated. In the implementation shown, the impeller 22 is rotated counterclockwise, as viewed in FIG. 16 and as indicated by arrow 80, by the motor to take fuel in through the inlet 42 and discharge fuel under pressure through the outlet 44. Each vane 64*b* has a leading face 82 and a trailing face 84 that is disposed circumferentially behind the leading face, relative to the direction of rotation. If desired, the shape of the leading and trailing faces 82, 84 may be the same, or nearly so, so that the vanes 64*b* have a generally uniform circumferential thickness. As shown in FIG. 15, each vane 64*b* may be generally v-shaped in cross-section with ends adjacent to each axial face 60, 62 of the impeller 22 leading (i.e. inclined forwardly relative to the direction of rotation) an axial mid-point 86 of the vane. FIG. 14 shows a similar view of some vanes 64*a* from the inner vane array 66. In this way, the vanes 64*a,b* may be defined as having an upper half that extends axially from the upper face 62 of the impeller 22 to the mid-point 86 and a lower half that extends axially from the mid-point 86 to the lower face 60 of the impeller 22. The axial midpoint 86 of each vane 64*b* trails the portion of each vane adjacent the upper face 62 of the impeller 22. And the axial mid-point 86 of each vane 64*b* trails the portion of the vane adjacent the lower face 60 of the impeller 22. This provides a generally concave vane in the cross-section views of FIGS. 14 and 15. Preferably, in cross-section, the front face of both the upper and lower halves of the vanes 64*a,b* is also concave, and the rear face of each half is convex.

Figure 17:
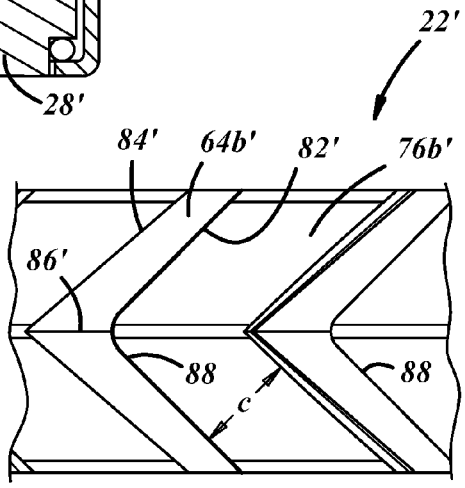
FIG. 17 is an enlarged, fragmentary sectional view of a modified impeller.

In FIGS. 14 and 15, the upper and lower halves of the vanes 64*b* converge at the mid-point 86 and may define a relatively sharp transition and the v-shape as discussed above. The angle β defined between the upper and lower halves in each vane may be between 60° and 130°. A modified impeller 22' is shown in FIG. 17 wherein the leading face 82' of each vane 64*b'* has an arcuate or radiused region 88 in the area the axial mid-point 86' of each vane, providing more of a U-shape in that area rather than a sharp V-shape. The radius may be 90% less than to 50% greater than the minimum spacing in any direction (nominally denoted by dimension "c", which could be at other positions and angles in other designs) between (1) the leading face 82' of a vane and (2) the trailing face 84' of the adjacent vane, along the axial length of the vanes. So, by way of a non-limiting example, if the minimum length or distance of the vane pocket 76*b'* is 1 mm, then the radius would be between 0.1 mm and 1.5 mm.

As shown in FIG. 2, an angle ψ is formed between the entrance portion 58 of a pumping channel 46 or 48 and the lower half of an associated vane 64*a* or 64*b*. Preferably, but not necessarily, the angle ψ is greater than 109° for both pumping channels 46 and 48 and associated vanes 64*a* and 64*b*. In at least some implementations, the angle ψ for the inner pumping channel 46 and inner vanes 64*a* is between 110° and 120°, and may be about 114°. In at least some implementations, the angle ψ for the outer pumping channel 48 and outer vanes 64*b* is between 110° and 125°, and may be about 121-122°.

Referring again to FIG. 16, each vane 64*b* includes a root segment 90 that extends outwardly from the mid-hoop 72 (the root segment 90 of the vanes 64*a* in the inner array 66 extend outwardly from the hub 70 rather than the mid-hoop 72). The root segment 90 may be linear, or nearly so, if desired, and may be between about 10% to 50% of the radial length of the vane 64*b*. The root segment 90 may extend at an angle α to a radial line 92 extending from the axis of rotation 24 through a point A on the trailing face 84 of the vane at the radially inward end of the root segment 90. The angle α may be between about −20° to 10° and is shown between the radial line 92 and a line 93 extending along the root segment 90 on the trailing face 84 of the vane 64*b*. An angle less than zero indicates that the root segment 90 (and hence, line 93) is inclined rearwardly compared to the radial line 92 and relative to the direction of rotation 80. An angle greater than zero indicates that the root segment 90 is inclined forwardly compared to the radial line 92 and relative to the direction of rotation. In one presently preferred embodiment, α is about −3° which means the root segment 90 is retarded or angled rearwardly of the radial line 92.

Each vane 64*b* also includes a tip segment 96 that extends from the radially outer end of the root segment 90 to the outer hoop 74 (the tip segment 96 of the vanes 64*a* in the inner array 66 extend to the mid-hoop 72 rather than the outer hoop 74). As shown in the drawings, tip segment 96 is slightly curved such that it is convex (when viewed in a direction parallel to the axis of rotation 24) with respect to the direction of rotation 80. Thus, the radially outermost portion of the tip segment 96 trails the root segment 90 relative to the direction of rotation 80. An angle δ is formed between the radial line 92 and a line 98 extending from a point A at the mid-hoop 72 on the trailing face 84 of the vane (i.e. the base of the root segment 90) to a point C at the outer hoop 74 on the trailing face 84 of the vane (i.e. the end of the tip segment 96). The angle δ may be between about 0° and −30°, where zero degrees coincides with the radial line 92 and angles of less than zero degrees indicate that the line 98 trails the radial line 92 relative to the direction of rotation 80. In one presently preferred embodiment, angle δ is about −12° which means the vane 64*b* is retarded or angled rearwardly of the radial line 92. The orientation of the vane 64*b* may also be described with referent to a line 100 that extends from point D at the radial mid-point 86 of the vane 64*b* to point C. Line 100 may form an angle ϵ with the radial line 92, and this angle ϵ may range between about 5° and 45°. If desired, tip segment 96 may have a generally uniform curvature that may be defined by an imaginary radius in the range of between 2 mm to 30 mm. In at least one implementation, no portion of the vane 64*b* extends forwardly of or leads the radial line 92, relative to the direction of rotation of the impeller. And the tip segment 96 of the vane may extend more rearwardly of the radial line 92 than the root segment 90.

Figure 18:
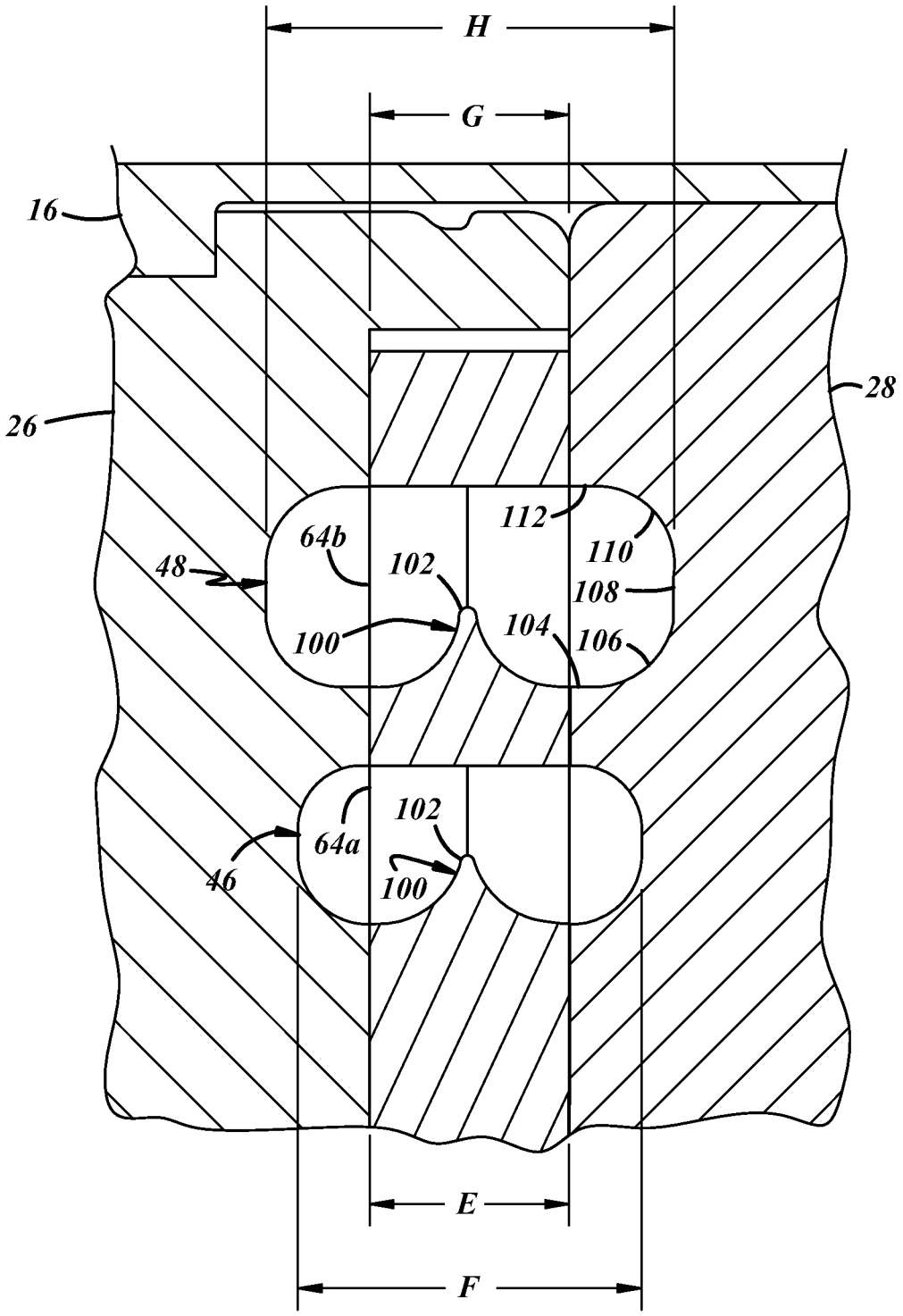
FIG. 18 is an enlarged fragmentary sectional view of the impeller assembled in the upper and lower caps.
Figure 20:
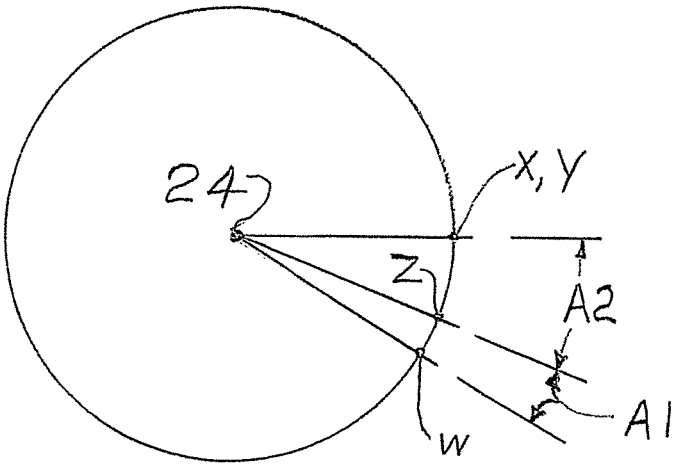
FIG. 20 is a schematic of a circumferential offset of the downstream end of the fuel outlet in the upper and lower caps and their circumferential location relative to the upstream end of the fuel inlet in the upper and lower caps.

As shown in FIGS. 16 and 18, a rib or partition 100 extends circumferentially between adjacent vanes with a tip 102 axially centered between the faces 60, 62 of the impeller. The rib 100 may extend radially outwardly, and may extend between about ¼ and ½ of the radial extent of its associated vanes. As shown in FIG. 18, preferably but not necessarily, each groove in cross-section has a straight section 104, a first curved section 106, a bottom straight section 108, a second curved section 110, and a straight section 112. Each straight section 104, 112 may be perpendicular to the adjacent face of the impeller 22 and the straight section 108 may be parallel to an adjacent face of the impeller. The curved sections 106 and 110 may have radii of the same length with different centers and blend smoothly into the adjoining straight sections at both ends of each curved section.

As shown in FIG. 18, the axial extent E of each inner vane 64*a* to the axial extent F of its pumping channel 46 may (but is not required to) have the relationship of $F/E<0.6$. The axial extent G of each outer vane 64*b* to the axial extent H of its pumping channel 48 may have the relationship of $H/G>0.76$. Preferably, but not necessarily, in a plane containing the impeller axis 24, the ratio of the area $A_2$ of a pump channel 46 or 48 including the area of an associated vane 64*a* or 64*b* to the area $A_1$ of its associated vane 64*a* or 64*b* excluding the area of its rib 100 is $A_2/A_1<1.0$. In at least some implementations, for the inner channel 46 and inner vanes 64*a*, $A_2/A_1\leq0.7$, and for the outer channel 48 and outer vanes 64*b*, $A_2/A_1\leq0.9$.

In operation, rotation of impeller 22 causes fuel to flow into the pump assembly 12 via the fuel inlet passage 42, which communicates with the inner and outer pumping channels 46, 48. The rotating impeller 22 moves fuel from the inlet 42 toward the outlet 44 of the fuel pumping channels and increases the pressure of the fuel along the way. Once the fuel reaches the annular end of the pumping channels 46, 48, the now pressurized fuel exits pump assembly 12 through the fuel outlet passage 44. Because the fluid pressure increases between the inlet and outlet of the pump assembly 12, orienting the vanes 64*a,b* so that they are rearwardly inclined (that is, they trail the radial line 92 as discussed above) improves circulation of the fluid within the vane pockets 76*a,b* and pumping channels 46, 48 because the higher pressure upstream of a vane pocket 76*a,b* helps to move fluid radially outwardly since the fluid pressure at the tip segment 96 may be slightly lower than the fluid pressure at the root segment 90 when the tip segment 96 trails the root segment 90. If the tip segment 96 were advanced forward of the root segment 90, then the pressure at the radially outwardly located tip segment would be greater than the pressure at the root segment and this tends to inhibit circulation and outward flow of the fluid in at least some implementations.

Further, orienting the root segment 90 at a different angle than the tip segment 96, and generally at a lesser trailing angle than the tip segment, helps to move fluid in the lower pressure inlet region of the pumping channels 46, 48. It is believed that the more radially oriented root segments 90 tend to lift the fluid axially and improve flow and circulation of the fluid in the inlet regions. This tends to improve performance of the pump assembly 12 in situations where the fluid is hot and poor or turbulent flow might lead to vapor formation or other inefficient conditions.

Therefore, in one sense, it can be considered that the root segment is designed for improved low pressure and hot fluid performance and the tip segment is designed for improved higher pressure performance. With these performance characteristics, the impeller and pump assembly are well-suited for use in various fluids, including volatile fuels such as unleaded gasolines and ethanol based fuels such as are currently used in automotive vehicles.

Figure 19:
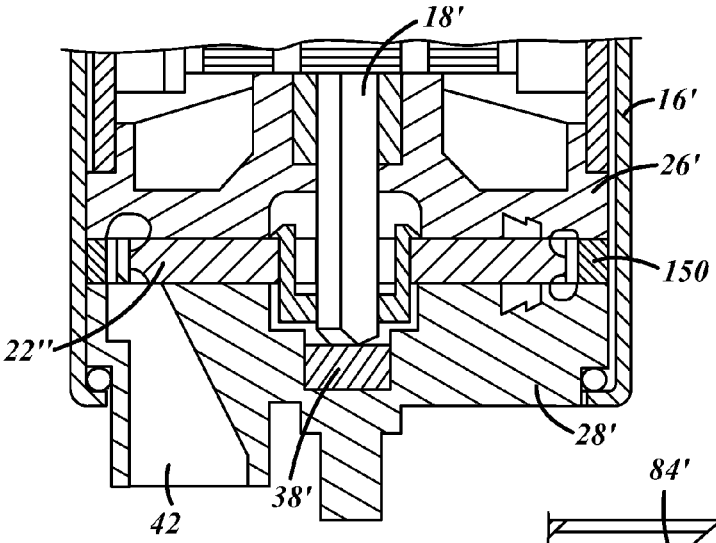
FIG. 19 is a fragmentary sectional view of an alternate fuel pump including a ring radially surround at least a portion of the impeller.

As shown in FIGS. 1-6, one or both of the upper and lower cap may have an integral radially outwardly located and circumferentially and axially extending flange 35 (shown on upper cap 26 in this implementation) defining a side wall or boundary of the impeller cavity that may be formed in one-piece with the cap. Alternatively, a separate ring 150 may be disposed between the upper and lower caps 26', 28' and surrounding the impeller 22", as shown in FIG. 19 (FIG. 19 shows a different pump with a different style impeller than the other embodiments discussed above. The impeller of FIG. 19 has only one array of vanes although other vane arrays may be provided. FIG. 19 is provided mainly for its depiction of the ring 150). With either the separate ring 150 or the integral flange 35, the impeller 22, 22', 22" may be machined while in position relative to the ring or flange so that a face of the impeller and the ring or flange are machined at the same time. Representative ways this may be accomplished include inserting the impeller into the ring and machining them together as a set (perhaps with a predetermined thickness differential provided for in a jig or die in which the parts are received for machining), or placing an impeller and ring set into separate portions of a jig or die and machining them generally at the same time though not assembled together. Of course, multiple sets of impellers and guides could be machined at one time, preferably with pairs of impellers and rings maintained together through whatever further processing and assembly steps may occur.

When machined at the same time, the axial thicknesses of these components can be carefully controlled and tolerances or variations from part-to-part in both components can be reduced or eliminated to provide an end product with more tightly controlled tolerances. In at least some implementations, the difference in axial thickness between the impeller and either the ring or flange is about 10 microns or less. The close tolerances and reduced variation from pump-to-pump in a product run help to control the volume of the pumping channels in relation to the axial thickness of the impeller, and maintain a desired clearance between the impeller faces and the adjacent surfaces of the upper and lower caps. This can help improve the consistency between pumps and maintain a desired performance or efficiency across a production run or runs of fluid pumps.

The foregoing description is of preferred exemplary embodiments of the fluid pump; the inventions discussed herein are not limited to the specific embodiments shown. Various changes and modifications will become apparent to those skilled in the art and all such changes and modifications are intended to be within the scope and spirit of the present invention as defined in the following claims. For example, while the drawings show a dual channel, single stage fluid pump, the impeller and other components may be utilized in other pump arrangements, including single channel or more than two channel arrangements, as well as multiple stage pumps. Also, where the vanes 64*a,b* have a generally uniform circumferential thickness along their radial extents, the angles discussed with regard to lines drawn relative to the trailing face of the vanes could also be discussed and applied with regard to lines drawn to the leading face of the vanes.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A fluid pump, comprising:

an electric motor having an output shaft driven for rotation about an axis;

a pump assembly coupled to the output shaft of the motor and having:

a first cap and a second cap with at least one pumping channel defined between the first cap and the second cap, and an impeller received between the first cap and the second cap, wherein the impeller has a hub and a hoop, is driven for rotation by the output shaft of the motor and the impeller includes a plurality of vanes disposed between the hub and the hoop and in communication with said at least one pumping channel, each vane has a leading face with a root segment and a curved tip segment and the root segment extends between 10% and 50% of the radial length of each vane;

the leading face of each vane is configured so that a line from a base of the root segment to an outer edge of the tip segment trails a line extending from the axis of rotation to the base of the root segment by a first angle of between 0° and −30° relative to the direction of rotation of the impeller;

the leading face of each vane is also configured so that a line extending from the base of the root segment to the outer end of the root segment is inclined relative to a line extending from the axis of rotation to the base of the root segment by between −20° and 10° relative to the direction of rotation of the impeller;

the leading face of each vane is also configured so that a line extending from a radial mid-point of the vane to a radially outer edge of the vane is inclined relative to a line extending from the axis of rotation to the radial mid-point of the vane by between −5° and −45° relative to the direction of rotation of the impeller;

the leading face of each vane is curved from at least the radial mid-point to the tip of such leading face; and the leading face of each vane is also configured so that the tip segment is inclined rearwardly to a greater extent than the root segment relative to the direction of rotation of the impeller.

2. The fluid pump of claim 1 wherein each vane has an upper portion extending from an upper face of the impeller to an axial mid-point of the vane and a lower portion extending from the axial mid-point of the vane to a lower face of the impeller, and the transition from the upper portion to the lower portion along the leading face of the vane is radiused providing a generally u-shaped leading face of the vane in cross section.

3. The fluid pump of claim 2 wherein each vane also has a trailing face and the radius is between 90% less than to 50% greater than the minimum spacing between the trailing face of a vane and the leading face of an immediately circumferentially adjacent trailing vane, along the axial length of these faces of these adjacent vanes.

4. The fluid pump of claim 1 wherein the first cap includes an inlet passage through which fuel is admitted to the pumping channel and an entrance portion of the pumping channel, and the entrance portion of the pumping channel is disposed at an angle of between 0 and 30 degrees relative to an internal surface of the first cap and facing the impeller.

5. The fluid pump of claim 4 wherein the entrance portion is disposed at angle of between 13 and 14 degrees.

6. The fluid pump of claim 4 wherein the inlet passage is formed in both the first and second caps, and an upstream edge of the inlet passage at a face of the first cap confronting the impeller is aligned with an upstream edge of the inlet passage at a face of the second cap confronting the impeller so that a line through these upstream edges is parallel to the axis of rotation of the impeller.

7. The fluid pump of claim 4 which also includes an outlet passage from which fuel is discharged from the pumping channel, a downstream edge of the outlet passage at a face of the first cap confronting the impeller and a downstream edge of the outlet passage at a face of the second cap confronting the impeller and these downstream edges of the outlet passage are circumferentially offset by an angle between 0 degrees to 20 degrees, where the angle is measured between two lines each extending radially from the axis of rotation of the impeller and through a respective one of these downstream edges.

8. The fluid pump of claim 7 wherein the angle of the circumferential offset is between 3 to 5 degrees.

9. The fluid pump of claim 4 wherein an upstream edge of the inlet passage at a face of the first cap confronting the impeller and an upstream edge of the inlet passage at a face of the second cap confronting the impeller are circumferentially offset from a downstream edge of the outlet passage at a face of the second cap confronting the impeller by an angle with its vertex on the axis of rotation of the impeller by between 10 and 25 degrees.

10. The fluid pump of claim 9 wherein the circumferential offset is between 22 and 24 degrees.

11. The fluid pump of claim 1 wherein the first cap includes an inlet passage through which fuel is admitted to the pumping channel and the inlet passage has an entrance portion directly adjacent to the pumping channel, and an angle greater than 109 degrees is formed between the entrance portion of a pumping channel and a lower half of a vane disposed in the pumping channel.

12. The fluid pump of claim 11 which includes an inner pumping channel and an outer pumping channel, and the impeller includes an inner array of vanes located in the inner pumping channel and an outer array of vanes located in the outer pumping channel, and the angle between the entrance portion of the inner pumping channel and a lower half of a vane in the inner array of vanes is between 110 and 120 degrees.

13. The fluid pump of claim 11 which includes an inner pumping channel and an outer pumping channel, and the impeller includes an inner array of vanes located in the inner pumping channel and an outer array of vanes located in the outer pumping channel, and the angle between the entrance portion of the outer pumping channel and a lower half of a vane in the outer array of vanes is between 110 and 125 degrees.

14. The fluid pump of claim 1 which includes an inner pumping channel and an outer pumping channel, and the impeller includes an inner array of vanes located in the inner pumping channel and an outer array of vanes located in the outer pumping channel, and the ratio of the axial extent of each inner vane to the axial extent of the inner pumping channel is less than 0.6.

15. The fluid pump of claim 1 which includes an inner pumping channel and an outer pumping channel, and the impeller includes an inner array of vanes located in the inner pumping channel and an outer array of vanes located in the outer pumping channel, and the ratio of the axial extent of each outer vane to the axial extent of the outer pumping channel is greater than 0.76.

16. An impeller for a fluid pump, comprising:

a hub having an opening adapted to receive a shaft that drives the impeller for rotation, a mid-hoop spaced radially from the hub and an outer hoop spaced radially from the mid-hoop;

an inner array of vanes located radially outwardly of the hub and inwardly of the mid-hoop; and an outer array of vanes located between the mid-hoop and the outer hoop, both the inner array of vanes and the outer array of vanes configured to communicate with a single common fluid inlet and a single common fluid outlet, each vane in the inner array and the outer array has a leading face and a trailing face spaced circumferentially behind the leading face relative to the intended direction of rotation of the impeller, each vane has a root segment and a curved tip segment extending generally radially outwardly from the root segment, and the root segment extends between 10% and 50% of the radial length of each vane;

the leading face of each vane is configured so that a line from a base of the root segment to an outer edge of the tip segment trails a line extending from the axis of rotation to the base of the root segment by a first angle of between 0° and −30°, relative to the direction of rotation of the impeller;

the leading face of each vane is also configured so that a line extending from a radial mid-point of the vane to a radially outer edge of the vane is inclined relative to a line extending from the axis of rotation to the radial mid-point of the vane by a second angle of between −5° and −45° relative to the direction of rotation of the impeller; and the leading face of each vane is also configured so that a line extending from the base of the root segment to the outer end of the root segment is inclined relative to a line extending from the axis of rotation to the base of the root segment by a third angle of between −20° and 10° relative to the direction of rotation of the impeller;

the leading face of each vane is curved from at least the radial mid-point to the tip of such leading face; and the leading face of each vane is also configured so that the tip segment is inclined rearwardly to a greater extent than the root segment relative to the direction of intended rotation of the impeller.

17. The impeller of claim 16 wherein each vane has an upper portion extending from an upper face of the impeller to an axial mid-point of the vane and a lower portion extending from the axial mid-point of the vane to a lower face of the impeller, and the transition from the upper portion to the lower portion along the leading face of the vane is radiused providing a generally u-shaped leading face of the vane in cross section.

18. The impeller of claim 17 wherein the leading face of each vane has a radius between the upper portion and the lower portion and the radius is between 90% less than to 50% greater than the minimum spacing between the trailing face of a vane and the leading face of an immediately circumferentially adjacent trailing vane, along the axial length of these faces of these adjacent vanes.

19. The impeller of claim 16 wherein each vane is generally v-shaped in cross-section with ends adjacent to each axial face of the impeller leading an axial mid-point of each vane relative to the direction of rotation of the impeller.

20. The impeller of claim 16 wherein each vane has an axial midpoint between axially spaced faces of the impeller, an upper half of each vane defined from an upper face of the impeller to the midpoint and a lower half of each vane defined between the lower face of the impeller to the midpoint, and the upper and lower halves of each vane are configured to define an angle between them of 60 to 30 degrees.

21. The impeller of claim 16 wherein the first angle is between −12 and −30 degrees relative to the intended direction of rotation of the impeller.

22. The method of making a fluid pump impeller, comprising:

forming an impeller having a plurality of vanes in axially opposed faces and adapted to be rotated about an axis, forming a body that defines a radially outer sidewall of an impeller cavity in which the impeller rotates, the body having at least one generally axial face;

positioning the impeller and the body so that one axial face of each may be machined at substantially the same time; and machining one axial face of the impeller and the body while so positioned and at substantially the same time to provide a similar axial thickness of the outer sidewall of the body and of the impeller.

23. The method of claim 22 wherein the resulting difference in the axial thickness between the impeller and the sidewall is 10 microns or less.

24. The method of claim 22 wherein the impeller is received between first and second caps in use and the body is an annular ring that is formed separately from the first and second caps.

25. The method of claim 22 wherein the impeller is received between first and second caps in use and the body is an annular flange that is formed in one piece with one of the first or second caps.

26. The method of claim 22 further comprising positioning the impeller radially inwardly of the outer sidewall at least while machining the one axial face of the impeller and the outer sidewall of the body to provide the similar axial thickness of both the outer sidewall and the impeller.

27. The method of claim 26 wherein the resulting difference in the axial thickness between the impeller and the sidewall is 10 microns or less.

28. The method of claim 26 wherein the impeller is received between first and second caps in use and the body is an annular ring that is formed separately from the first and second caps.

29. The method of claim 26 wherein the impeller is received between first and second caps in use and the body is an annular flange that is formed in one piece with one of the first or second caps.

* * * * *